US009051038B1

(12) United States Patent
Herber

(10) Patent No.: US 9,051,038 B1
(45) Date of Patent: Jun. 9, 2015

(54) SYSTEM AND METHOD FOR PROPELLING A WATERCRAFT UTILIZING HUMAN POWER

(71) Applicant: Paul G. Herber, Riviera Beach, FL (US)

(72) Inventor: Paul G. Herber, Riviera Beach, FL (US)

( * ) Notice: Subject to any disclaimer, the term of this patent is extended or adjusted under 35 U.S.C. 154(b) by 0 days.

(21) Appl. No.: 14/132,572

(22) Filed: Dec. 18, 2013

Related U.S. Application Data

(60) Provisional application No. 61/740,578, filed on Dec. 21, 2012.

(51) Int. Cl.
*B63H 16/20* (2006.01)
*B63B 35/79* (2006.01)

(52) U.S. Cl.
CPC ..... *B63H 16/20* (2013.01); *B63B 35/79* (2013.01); *B63B 35/7926* (2013.01)

(58) Field of Classification Search
CPC ..... B63H 16/00; B63H 16/02; B63H 16/04; B63H 16/08; B63H 16/12; B63H 16/14; B63H 16/18; B63H 16/20; B63B 35/79; B63B 16/7943
USPC ..... 441/65, 74, 79; 114/343, 364; 440/21, 440/26, 32
See application file for complete search history.

(56) References Cited

U.S. PATENT DOCUMENTS

| | | | | |
|---|---|---|---|---|
| 1,578,584 | A * | 3/1926 | Cromer | 440/27 |
| 3,779,202 | A * | 12/1973 | Martin et al. | 114/283 |
| 4,321,048 | A | 3/1982 | Marchese et al. | |
| 4,772,237 | A * | 9/1988 | Zalkauskas | 440/96 |
| 5,368,507 | A * | 11/1994 | Harris | 440/29 |
| 7,097,521 | B1 | 8/2006 | Papadakis | |
| 7,232,350 | B1 | 6/2007 | Krah | |
| 7,267,586 | B1 * | 9/2007 | Murphy | 440/32 |
| 7,371,138 | B2 * | 5/2008 | Spass | 440/27 |
| 7,513,808 | B1 | 4/2009 | Murphy | |
| 7,699,017 | B1 * | 4/2010 | Marshall | 114/315 |
| 7,736,205 | B2 | 6/2010 | Krah | |
| 8,043,134 | B2 | 10/2011 | Krah | |

* cited by examiner

*Primary Examiner* — Daniel V Venne
(74) *Attorney, Agent, or Firm* — Craig Hoersten

(57) ABSTRACT

An aquatic device, such as a paddle board or surfboard, that includes a propulsion device that utilizes paddle wheels positioned on either side of the board, wherein the paddle wheels are driven by foot operated drive mechanism that utilizes elliptical type of pedaling by the user, and further includes hand controlled rudders to control the direction of travel of the device.

19 Claims, 3 Drawing Sheets

SYSTEM AND METHOD FOR PROPELLING A WATERCRAFT UTILIZING HUMAN POWER

CROSS-REFERENCE TO RELATED PATENTS

The present U.S. Utility Patent Application claims priority pursuant to 35 U.S.C. §119(e) to U.S. Provisional Application Ser. No. 61/740,578, entitled, "SYSTEM AND METHOD FOR PROPELLING A WATERCRAFT UTILIZING HUMAN POWER", filed Dec. 21, 2012, which is incorporated by reference herein and made part of the present U.S. Utility Patent Application for all purposes.

TECHNICAL FIELD

This invention relates generally to human power watercraft, and in particular to human power watercrafts, surfboards and paddle boards, and human power propulsion devices for watercraft, surfboards and paddle boards.

BACKGROUND

Stand-up paddle boarding is a water sport that has gained popularity over recent years. Typically, the sport is performed using a large, buoyant board with a flat upper surface on which a user stands, and which is propelled by the user via a long handled paddle. Conventional stand-up paddle boards (SUPs) typically range from 10-12 feet long, 2.5-3 feet wide, and around 6 inches in thickness.

Existing SUPs are optimized neither for speed nor for surfing on waves; rather, their large shape and buoyancy make them suitable for slower waves and for merely cruising on flatter water. This large shape also tends to reduce maneuverability of a SUP for turns and control, and above certain speeds, the typical SUP can become very unstable, particularly for being driven into the water nose-first and causing the SUP to flip end-over-end.

Adding to the instability of users on SUPs, is the lack of something secure to grab for users to maintain or recover their balance, especially when users are attempting to mount the SUPs, or when, for various reasons, the users lose their balance when already on the SUPS.

DETAILED DESCRIPTION OF THE INVENTION

Figure 1:
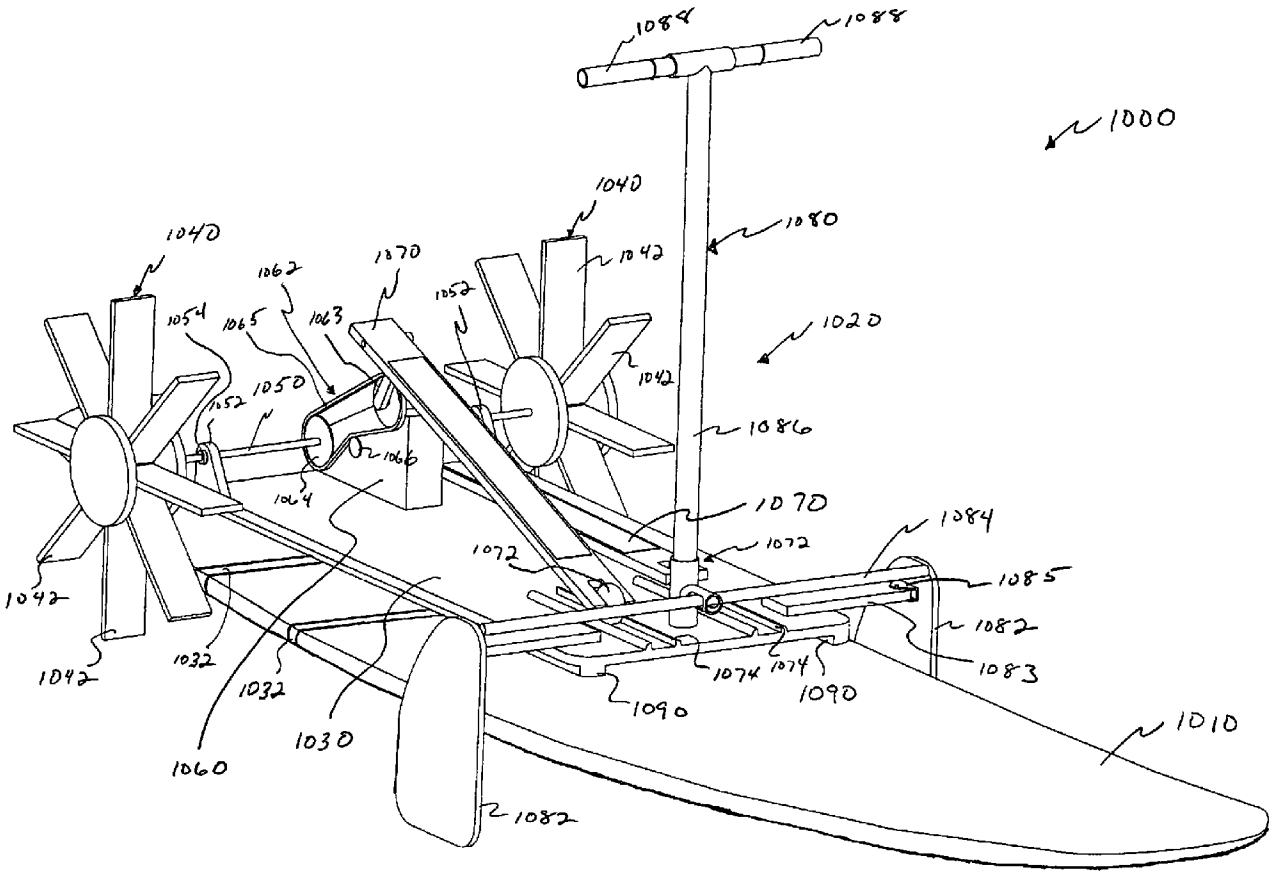
FIG. 1 illustrates a perspective view of an embodiment of a human powered paddle board in accordance with the present invention.

Referring now to the drawings, wherein various elements depicted are not necessarily drawn to scale and wherein, through the views and figures, like elements may be referenced with identical or similar reference numerals, there is illustrated various embodiments of a paddle board, with human powered paddle wheel propulsion mechanisms.

As seen in FIG. 1, there is illustrated an embodiment of a paddle board system 1000. Paddle board system 1000 includes a paddle board 1010 and a propulsion device 1020. The propulsion device 1020 includes a platform 1030 that is secured to the top surface of paddle board 1010. Platform 1030 is positioned on top of paddle board 1010, and provides a stable base for the other components of the propulsion device 1020 to be integrated and attached.

The propulsion device 1020 is secured to paddle board 1010 using straps 1032, however it is contemplated that various types of attachment mechanisms could be utilized, such as but not limited to, hook/loop fasteners, suction cups, clamps, screws, bolts, tab/slot assembly, and chemical bonding agents. It is further contemplated that the propulsion device 1020 can be either removably attached to the paddle board 1010 or can be permanently mounted to or integrated with paddle board 1010.

Rotatably secured to the rear surface of the platform 1030 are paddle wheels 1040, which are interconnected via a paddle wheel axle 1050. The axle 1050 is positioned perpendicular to the length of paddle board 1010 and extends over the top surface of the platform 1030, with a paddle wheel 1040 connected at each end. Axle 1050 extends through a pair of flanges 1052. Flanges 1052 are positioned proximate the edges of platform 1030 and extend upward from platform 1030. Flanges 1052 facilitate the maintenance of the alignment of axle 1050 and paddle wheels 1040. Each of the flanges 1052 includes bearings and collars 1054 to permit the rotation of axle 1050 at reduced friction, and to keep each of the paddle wheels 1040 from moving from side-to-side.

Each paddle wheel 1040 includes a plurality of elongated paddles 1042, that each extend radially outward from the center of each of the paddle wheels 1040. In this embodiment, each of paddles 1042, are rectangular and planar in shape, such that the rotation of paddle wheel 1040 causes the paddles 1042 to push against the water thereby moving the paddle board 1010 through the water. Although paddles 1042 are generally rectangular and planar in shape, it is contemplated that other shapes could be utilized as well. Further, paddles 1042 could be made from virtually any material, good results have been achieved utilizing lightweight materials, such as, but not limited to, woods, polymers, foam, plastics and other light weight buoyant materials.

Axle 1050 is further connected to and engages with a crank and axle housing 1060, which is secured to platform 1030 intermediate paddle wheels 1040. A pair of elongated step planks or pedals 1070 are each connected at one end the crank and axle housing 1060. Each of the step planks 1070 are connected to the crank housing in a manner to achieve an elliptical type of stair stepper motion, permitting the user to be able to rotate axle 1050, and thus paddle wheels 1040.

At the end of each of the step planks 1070, opposite the ends connected to the crank housing 1060, are roller wheels 1072. Platform 1030 includes a pair of wheel guides 1074 positioned on the top surface of platform 1030 proximate the front of platform 1030. Each of the wheel guides 1074 are positioned and shaped to receive therein the roller wheels 1072 so as to facilitate the movement of the roller wheels 1072 in a forward and backward linear vector when a user operates step planks 1070 in an up and down motion.

The crank and axle housing 1060 includes a crank system 1062 which consists of components that function to transfer the energy from the motion of the step planks 1070 to the axle 1050, causing the paddle wheels 1042 to rotate. Crank system 1062 includes a chain ring gear 1063 and a freewheel back axle gear 1064, with gears 1063 and 1064 being interconnected via a chain 1065. Freewheel back axle gear 1064 is a sprocket that is connected to axle 1050 and is configured to be a freewheel in one direction, so that the user can coast and stop peddling but still permit the paddle board 1010 to move forward. A chain tensioning gear 1066, which includes idler gear and spring, is used to take up any slack in the chain 1065 that may occur which will facilitate the prevention of a derailment of the chain 1065 from gears 1063 and 1064.

Secured to the front portion of the platform 1030 is a steering apparatus 1080. Steering apparatus 1080 includes a pair of pivoting rudders 1082, with a single rudder positioned on each side of the paddle board 1010. Each of the rudders 1082 are pivotally connected to a tie rod 1084 at either end via pivot hinge 1083 and hinge mounts 1085. The tie rod 1084 extends over the top of platform 1030 approximately perpendicular to the length of paddle board 1010. Each of the rudders 1082 are configured to be of a length to extend into the water, when the paddle board system 1000 is placed in a body of water. Additionally, each of the rudders 1082 are shaped to steer the paddle board 1010 while facilitating the movement of paddle board 1010 through the water.

A t-shaped steering bar 1086, positioned intermediate rudders 1082, is engaged with and extends upward from rod 1084, away from the top surface of paddle board 1010. At the top of the t-shaped steering bar 1086 at each end are hand grips 1088 to improve comfort and gripping performance for the hands of the user.

Positioned proximate the lateral edges of the underside of the platform 1030 are rails 1090 that extend the length of the platform 1030. The rails 1090 facilitate the proper placement and securing of the platform 1030 to the top surface of paddle board 1010, especially when the top surface of the paddle board 1010 is curved, with the highest portion being down the middle length of paddle board 1010. As can be appreciated, in addition to or in place of, the bottom surface of platform 1030 could be shaped to match or mate with the upper surface of a particular paddle board for a "custom fit".

It is contemplated that at least some of the components of the propulsion device 1020, such as, but not limited to, the paddle wheels 1040 and the steering bar 1086, can be either removable or collapsible to facilitate non-water transportation.

In operation, the platform 1030 of propulsion device 1020 is placed onto and secured to the top surface of paddle board 1010. The paddle board 1010 and propulsion device 1020 are then placed in a body of water. The user will then mount the platform 1030, and, while holding the steering apparatus 1080, place their feet on the step planks 1070, one foot on each. The step planks 1070 with oscillate between opposing positions (upper and lower) with applied forces from the user in a manner similar to a stair stepper or an elliptical motion.

As the user applies alternating forces to the step planks 1070, the oscillating step planks 1070 drive axle 1050 via crank and axle housing 1060, which in turn causes the paddle wheels 1040 to rotate. As the paddle wheels 1040 rotate, the paddles 1042 engage the water, creating a propulsion force moving the paddle board system 1000 through the water. As the paddle board system 1000 is moving through the water, the bearing or heading of the movement thereof can be controlled and altered by the user rotating the steering bar 1086, causing the rudders 1082 to change orientation within the water, and thus changing or altering the direction of movement of the paddle board system 1000.

Figure 2:
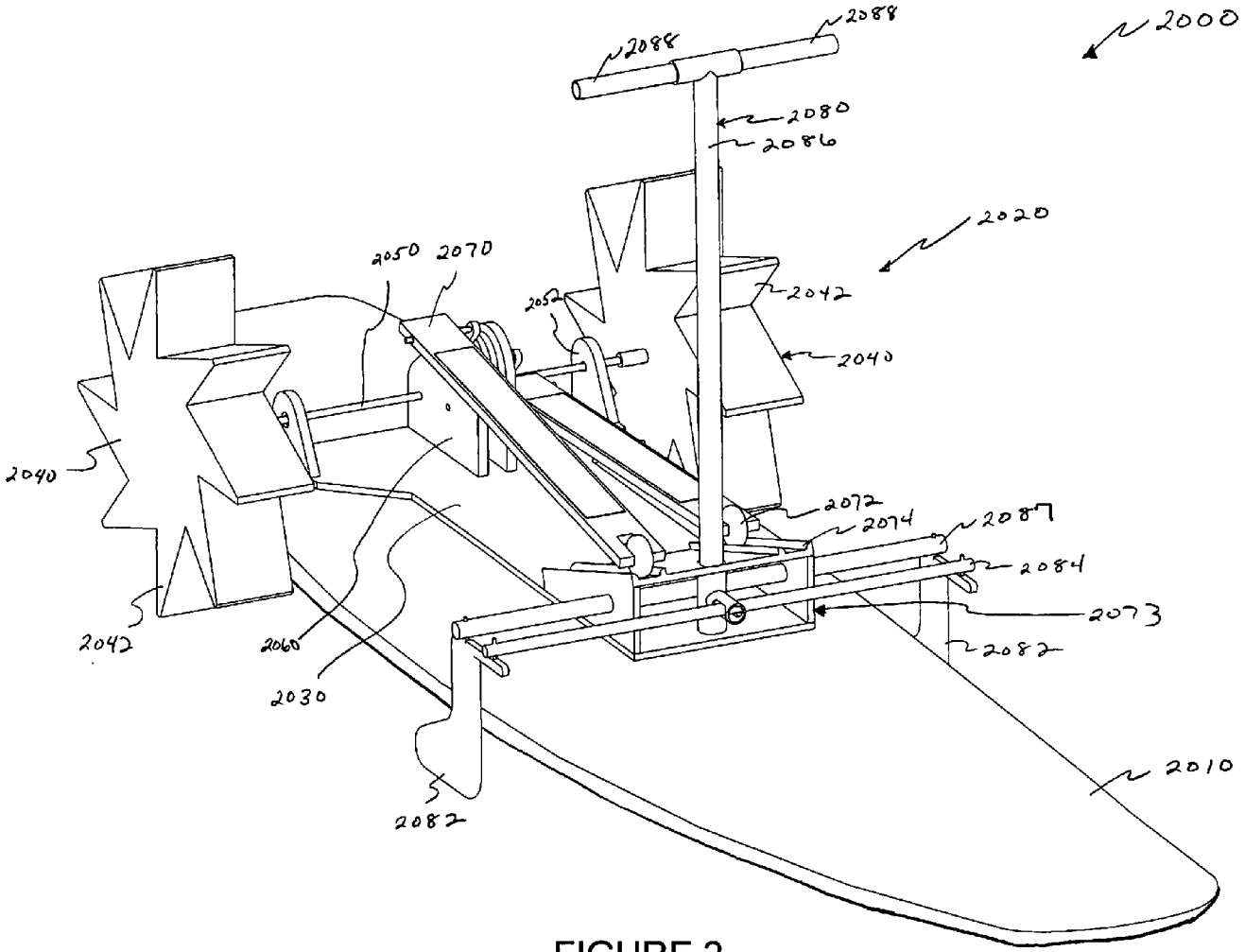
FIG. 2 illustrates a perspective view of another embodiment of a human powered paddle board in accordance with the present invention.

Referring now to FIG. 2, there is illustrated another embodiment of a paddle board system 2000. Paddle board system 2000 includes a paddle board 2010 and a propulsion device 2020. The propulsion device 2020 includes a platform 2030 that is securable to the top surface of paddle board 2010. Platform 2030 is positioned on top of paddle board 2010, and provides a stable base for the other components of the propulsion device 2020 to be integrated and attached.

The propulsion device 2020 can be secured to paddle board 2010 using various types of attachment mechanisms, such as but not limited to, hook/loop fasteners, suction cups, clamps, screws, bolts, tab/slot assembly, and chemical bonding agents. It is further contemplated that the propulsion device 2020 can be either removably attached to the paddle board 2010 or can be permanently mounted to or integrated with paddle board 2010.

Rotatably secured to the rear surface of the platform 2030 are paddle wheels 2040, which are interconnected via a paddle wheel axle 2050. The axle 2050 is positioned perpendicular to the length of paddle board 2010 and extends over the top surface of the platform 2030, with a paddle wheel 2040 connected at each end. Axle 2050 extends through a pair of flanges 2052. Flanges 2052 are positioned proximate the edges of platform 2030 and extend upward from platform 2030. Flanges 2052 facilitate the maintenance of the alignment of axle 2050 and paddle wheels 2040. As similarly illustrated in FIG. 1, each of the flanges 2052 may include bearings and collars to permit the rotation of axle 2050 at reduced friction, and to keep each of the paddle wheels 2040 from moving from side-to-side.

Each paddle wheel 2040 includes a plurality of paddles 2042, that each extend radially outward from the center of each of the paddle wheels 2040. In this embodiment, each of paddles 2042, are wedge shaped with the narrowest portion of each of the paddles occurring at the outer perimeter of the paddle wheel 2040. The shape and positioning of each of the paddles 2042 are such that the rotation of paddle wheel 2040 in water causes the paddles 2042 to push against the water thereby moving the paddle board 2010 through the water. In this embodiment, paddle wheels 2040 and paddles 2042 are made of light weight, buoyant materials, but not limited to, woods, polymers, foam, plastics and other light weight buoyant materials. The wedge shape and buoyancy of the paddles 2042 and paddle wheels 2040 help to provide stability for a user of the paddle board 2010. As paddle board 2010 tips to one side, the amount of buoyant material being submerged increase at an increasing rate due to the wedge shape of paddles 2042 and the hub of paddle wheels 2040, thus increasing the displacement of water at an increasing rate, making it more difficult for a user to tip or capsize paddle board 2010, i.e. stabilizing it. It is contemplated that shapes other than a wedge shape could be utilized, so long as the shape increases the displacement of water at an increasing rate, thus providing stabilization.

Axle 2050 is further connected to and engages with a crank and axle housing 2060, which is secured to platform 2030 intermediate paddle wheels 2040. A pair of elongated step planks or pedals 2070 are each connected at one end the crank and axle housing 2060. Each of the step planks 2070 are connected to the crank housing in a manner to achieve an elliptical type of stair stepper motion, permitting the user to be able to rotate axle 2050, and thus rotate paddle wheels 2040.

At the end of each of the step planks 2070, opposite the ends connected to the crank housing 2060, are roller wheels 2072. A roller platform 2073 extends upward from the front portion of platform 2030. On the upper surface of roller platform 2073 is a pair of wheel guides 2074, each being positioned and shaped to receive therein the roller wheels 2072 so as to facilitate the movement of the roller wheels 2072 in a forward and backward linear vector when a user operates step planks 2070 in an up and down motion. Roller platform 2073 is shaped to facilitate a more natural motion for the user.

The crank and axle housing 2060 includes a crank system as similarly described herein above with reference to the crank and axle housing 1060 of FIG. 1.

Secured to the front portion of the platform 2030 is a steering apparatus 2080. Steering apparatus 2080 includes a pair of pivoting rudders 2082, with a single rudder positioned on each side of the paddle board 2010. Each of the rudders 2082 are pivotally connected to a tie rod 2084 and secured to the platform 2030 via rudder mount 2087. The tie rod 2084 extends over the top of paddle board 2010 approximately perpendicular to the length of paddle board 2010. Each of the rudders 2082 are configured to be of a length to extend into the water, when the paddle board system 2000 is placed in a body of water. Additionally, each of the rudders 2082 are shaped to steer the paddle board 2010 while facilitating the movement of paddle board 2010 through the water.

A t-shaped steering bar 2086, positioned intermediate rudders 2082, is engaged with and extends upward from rod 2084, away from the top surface of paddle board 2010. At the top of the t-shaped steering bar 2086 at each end are hand grips 2088 to improve comfort and gripping performance for the hands of the user.

It is contemplated that at least some of the components of the propulsion device 2020, such as, but not limited to, the paddle wheels 2040 and the steering bar 2086, can be either removable or collapsible to facilitate non-water transportation.

In operation, the platform 2030 of propulsion device 2020 is placed onto and secured to the top surface of paddle board 2010. The paddle board 2010 and propulsion device 2020 are then placed in a body of water. The user will then mount the platform 2030, and, while holding the steering apparatus 2080, place their feet on the step planks 2070, one foot on each. The step planks 2070 with oscillate between opposing positions (upper and lower) with applied forces from the user in a manner similar to a stair stepper or an elliptical motion.

As the user applies alternating forces to the step planks 2070, the oscillating step planks 2070 drive axle 2050 via crank and axle housing 2060, which in turn causes the paddle wheels 2040 to rotate. As the paddle wheels 2040 rotate, the paddle portions 2042 engage the water, creating a propulsion force moving the paddle board system 2000 through the water. As can be appreciated, the direction of movement, either forward or aft, depends upon the direction of rotation of the paddle wheels 2040. As the paddle board system 2000 is moving through the water, the bearing or heading of the movement thereof can be controlled and altered by the user rotating the steering bar 2086, causing the rudders 2082 to change orientation within the water, and thus changing or altering the direction of movement of the paddle board system 2000.

Figure 3:
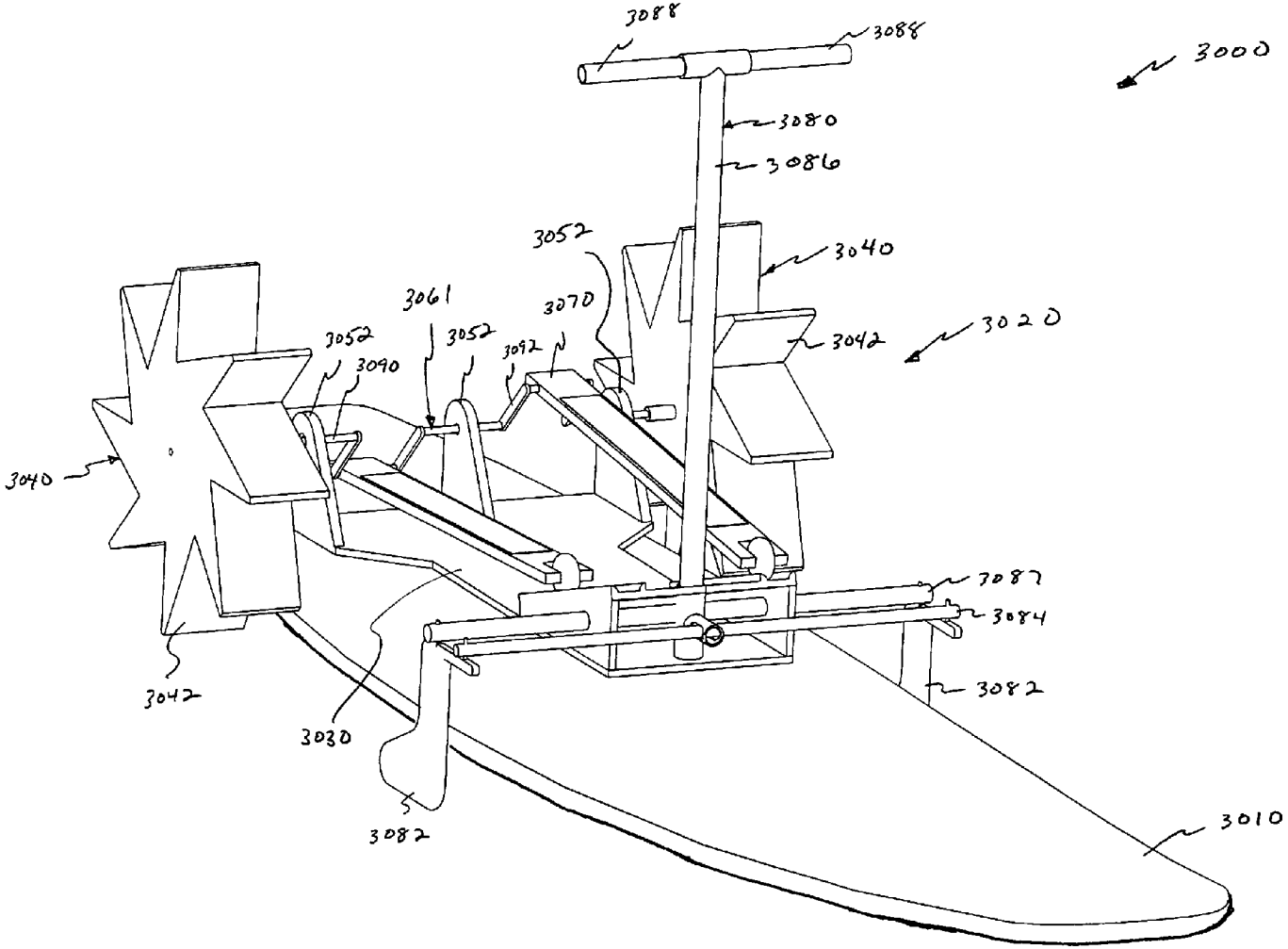
FIG. 3 illustrates a perspective view of yet another embodiment of a human powered paddle board in accordance with the present invention.

Referring now to FIG. 3, there is illustrated another embodiment of a paddle board system 3000 utilizing direct drive. Paddle board system 3000 includes a paddle board 3010 and a propulsion device 3020. The propulsion device 3020 includes a platform 3030 that is securable to the top surface of paddle board 3010. Platform 3030 is positioned on top of paddle board 3010, and provides a stable base for the other components of the propulsion device 3020 to be integrated and attached.

The propulsion device 3020 can be secured to paddle board 3010 using various types of attachment mechanisms, such as but not limited to, hook/loop fasteners, suction cups, clamps, screws, bolts, tab/slot assembly, and chemical bonding agents. It is further contemplated that the propulsion device 3020 can be either removably attached to the paddle board 3010 or can be permanently mounted to or integrated with paddle board 3010.

Rotatably secured to the rear surface of the platform 3030 are paddle wheels 3040, which are interconnected via axle and crank assembly 3061. The axle and crank assembly 3061 is positioned perpendicular to the length of paddle board 3010 and extends over the top surface of the platform 3030, with a paddle wheel 2040 connected at each end. The axle and crank assembly 3061 extends through three flanges 3052. The three flanges 3052 are positioned with 2 being proximate the edges of platform 3030 and one approximately midline of the platform 3030. Each of flanges 3052 extend upward from platform 3030. Flanges 3052 provide support for axle and crank assembly 3061 and facilitate the maintenance of the alignment of axle and crank assembly 3061 and paddle wheels 3040. As similarly illustrated in FIG. 1, each of the flanges 3052 may include bearings and collars to permit the rotation of axle and crank assembly 3061 at reduced friction, and to keep each of the paddle wheels 3040 from moving from side-to-side.

Each paddle wheel 3040 includes a plurality of paddle 3042, that extend radially outward from the center of each of the paddle wheels 3040. Each of paddles 3042, are wedge shaped with the narrowest portion of each of the paddles occurring at the outer perimeter of the paddle wheel 3040. The shape and positioning of each of the paddles 3042 are such that the rotation of paddle wheel 3040 in water causes the paddles 3042 to push against the water thereby moving the paddle board 3010 through the water. In this embodiment, paddle wheels 3040 and paddles 3042 are made of light weight, buoyant materials, such as, but not limited to, woods, polymers, foam, plastics and other light weight buoyant materials. The wedge shape and buoyancy of the paddles 3042 and paddle wheels 3040 help to provide stability for a user of the paddle board 3010. As paddle board 3010 tips to one side, the amount of buoyant material being submerged increase at an increasing rate due to the wedge shape of paddles 3042 and the hub of paddle wheels 3040, thus increasing the displacement of water at in increasing rate, making it more difficult for a user to tip or capsize paddle board 3010, i.e. stabilizing it.

As illustrated, axle and crank assembly 3061 includes axle portions 3090 and offset crank arms 3092. Crank and axle housing 3060 includes a crank system as similarly described herein above with reference to the crank and axle housing 1060 of FIG. 1.

Axle and crank assembly 3061 is connected directly to a pair of elongated step planks or pedals 3070 at one end of the offset crank arms 3092, with the other end of the offset crank arms connected to the axle portions 3090. Each of the step planks 3070 are connected to the axle and crank assembly 3061 in a manner to achieve an elliptical type of stair stepper motion, permitting the user to be able to directly control axle and crank assembly 3061, and thus rotate paddle wheels 3040.

At the end of each of the step planks 3070, opposite the ends connected to the axle and crank assembly 3061, are roller wheels 3072. A roller platform 3073 extends upward from the front portion of platform 3030. On the upper surface of roller platform 3073 is a pair of wheel guides 3074, each being positioned and shaped to receive therein the roller wheels 3072 so as to facilitate the movement of the roller wheels 3072 in a forward and backward linear vector when a user operates step planks 3070 in an up and down motion. Roller platform 3073 is shaped to facilitate a more natural motion for the user.

Secured to the front portion of the platform 3030 is a steering apparatus 3080. Steering apparatus 3080 includes a pair of pivoting rudders 3082, with a single rudder positioned on each side of the paddle board 3010. Each of the rudders 3082 are pivotally connected to a tie rod 3084 and secured to the platform 3030 via rudder mount 3087. The tie rod 3084 extends over the top of paddle board 3010 approximately perpendicular to the length of paddle board 3010. Each of the rudders 3082 are configured to be of a length to extend into the water, when the paddle board system 3000 is placed in a body of water. Additionally, each of the rudders 3082 are shaped to steer the paddle board 3010 while facilitating the movement of paddle board 3010 through the water.

A t-shaped steering bar 3086, positioned intermediate rudders 3082, is engaged with and extends upward from rod 3084, away from the top surface of paddle board 3010. At the top of the t-shaped steering bar 3086 at each end are hand grips 3088 to improve comfort and gripping performance for the hands of the user.

It is contemplated that at least some of the components of the propulsion device 3020, such as, but not limited to, the paddle wheels 3040 and the steering bar 3086, can be either removable or collapsible to facilitate non-water transportation.

In operation, the platform 3030 of propulsion device 3020 is placed onto and secured to the top surface of paddle board 3010. The paddle board 3010 and propulsion device 3020 are then placed in a body of water. The user will then mount the platform 3030, and, while holding the steering apparatus 3080, place their feet on the step planks 3070, one foot on each. The step planks 3070 with oscillate between opposing positions (upper and lower) with applied forces from the user in a manner similar to a stair stepper or an elliptical motion.

As the user applies alternating forces to the step planks 3070, the oscillating step planks 3070 directly drive axle portions 3090 via offset crank arms 3092, which in turn causes the paddle wheels 3040 to rotate. As the paddle wheels 3040 rotate, the paddle portions 3042 engage the water, creating a propulsion force moving the paddle board system 3000 through the water. As can be appreciated, the direction of movement, either forward or aft, depends upon the direction of rotation of the paddle wheels 3040. As the paddle board system 3000 is moving through the water, the bearing or heading of the movement thereof can be controlled and altered by the user rotating the steering bar 3086, causing the rudders 3082 to change orientation within the water, and thus changing or altering the direction of movement of the paddle board system 3000.

It is contemplated to be within the scope of this invention that various other designs could be utilized herein to translated leg power from a user to the propulsion system, such as by, way of example, standard rotatable pedals, a treadmill type translation, or even a cross-country ski type motion. Additionally, it is contemplated that other types of propulsion system could be utilized, such as, by way of example, sculling devices, and propellers/impellers.

It is further contemplated, that in additional embodiments the paddle wheels could operate in either a "forward" or "reverse" direction, to not only facilitate a user to go in either direction, but could also be used as breaking device, such that when a user is moving in one direction, changing the rotation of the paddles wheels would facilitate a stopping force for the paddle board. Additionally, it is contemplated that, in additional embodiments, the rotation speed and/or direction of each of the paddle wheels could be controlled separately to facilitate a steering effect.

It is further contemplated that the buoyancy and shape of the rudders could also be varied in a similar fashion the paddle portions of the paddle wheels to further aid in the stabilization of the paddle board.

It is also contemplated that in additional embodiments of the present invention, that in lieu of or in combination with the side positioned paddle wheels, a single or multiple paddle wheels could be positioned off the rear of the paddle board or off the front of the paddle board.

It is also contemplated that in the embodiments disclosed herein, that in lieu of or in conjunction with the rudders, the paddle wheels could configured to be rotatable to act in a "rudder-like" fashion to facilitate the steering of the paddle board.

It is also contemplated that in lieu of the roller wheels, a slide and rail configuration or a pendulum configuration could also be utilized.

As may be used herein, the terms "substantially" and "approximately" provides an industry-accepted tolerance for its corresponding term and/or relativity between items. As may further be used herein, inferred coupling (i.e., where one element is coupled to another element by inference) includes direct and indirect coupling between two items in the same manner as "coupled to". As may be used herein, the term "operable to" indicates that an item performs one or more of the described or necessary corresponding functions and may further include inferred coupling to one or more other items to perform the described or necessary corresponding functions. As may also be used herein, the term(s) "connected to" and/or "connecting" or "interconnecting" includes direct connection or link between items and/or indirect connection between items via an intervening item or items. As may further be used herein, inferred connections (i.e., where one element is connected to another element by inference) includes direct and indirect connection between two items in the same manner as "connected to".

Embodiments have also been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention.

What is claimed is:

1. An aquatic device, comprising:

an elongated, buoyant paddle board having a top surface, a first and second elongated edge, a front and a rear;

a propulsion system positioned on the top surface of the paddle board;

the propulsion system including, at least two paddle wheels, with a first paddle wheel positioned proximate the first elongated edge and the second paddle wheel positioned proximate the second elongated edge;

an axle rotatably connected to the first paddle wheel and the second paddle wheel; and foot operated drive mechanism rotatably connected to the axle, such that activation of the foot operated drive mechanism by a user cause the axle and first and second paddle wheels to rotate.

2. The aquatic device of claim 1, wherein each of the first and second paddle wheels include a plurality of wedge shaped paddle portions that extend radially from the center of each of the paddle wheels.

3. The aquatic device of claim 1, wherein the foot operated drive mechanism includes first and second elongated step planks.

4. The aquatic device of claim 1, further comprising at least one rudder connected to the paddle board.

5. The aquatic device of claim 4, and further comprising a steering device rotatably connected to the at least one rudder, such the rotation of the steering device causes the rotation of the at least one rudder.

6. The aquatic device of claim 1, wherein the propulsion system is removably attached to the paddle board.

7. An aquatic device, comprising:

an elongated, buoyant paddle board having a top surface, a first and second elongated edge, a front and a rear;

a propulsion system including;

a platform positioned on the top surface of the paddle board;

an elongated axle having a first end and second end, the axle being rotatably connected to the platform proximate the rear of the platform;

a first paddle wheel connected to the first end of the axle and a second paddle wheel connected to the second end of the axle such that when the axle rotates, each of the first and second paddle wheels rotate; and a first foot plank rotatably connected to the axle and a second foot plank rotatably connected to the axle, with each of the first foot plank and the second foot plank operable between at least a first position and a second position, such that the movement of the first foot plank and the second foot plank between the first position and the second position causes the axle and the first and second paddle wheels to rotate.

8. The aquatic device of claim 7, wherein each of the first and second paddle wheels include a plurality of wedge shaped paddle portions that extend radially from the center of each of the paddle wheels.

9. The aquatic device of claim 8, wherein the first and second paddle wheels are made of buoyant material.

10. The aquatic device of claim 9, wherein the first foot plank is connected to the axle at a first end of the first foot plank, and the second foot plank is connected to the axle at a first end of the second foot plank, and further wherein a wheel is connected to each of a second end of the first and second foot planks.

11. The aquatic device of claim 10, further comprising a first rudder rotatably connected to the platform.

12. The aquatic device of claim 11, further comprising a second rudder rotatably connected to the platform, with the first rudder connected proximate the front of the paddle board along the first elongated edge and the second rudder connected proximate the front of the paddle board along the second elongated edge.

13. The aquatic device of claim 12, further comprising a steering device rotatable connected to the first and second rudders, such that the rotation of the steering device causes the rotation of each of the first and second rudders.

14. The aquatic device of claim 13, wherein the propulsion system is removably attached to the paddle board.

15. A propulsion system for an aquatic device, comprising:

a platform configured to be positioned on a top surface of a buoyant device;

an elongated axle having a first end and second end, the axle being rotatably connected to the platform proximate the rear of the platform;

at least one propulsion device connected to a first end of the axle, such that when the axle rotates, the at least one propulsion device rotates, the at least one propulsion device including a paddle wheel, the paddle wheel including a plurality of wedge shaped portions extending radially from the center of the paddle wheel; and a foot operated drive mechanism rotatably connected to the axle, such that activation of the foot operated drive mechanism by a user causes the axle and the at least one propulsion device to rotate.

16. The propulsion system of claim 15, further comprising at least one rudder rotatably connected to the platform.

17. The propulsion system of claim 16, wherein the foot operated drive mechanism includes a first plank with one end rotatably connected to the axle and a second plank with one end rotatably connected to the axle.

18. The propulsion system of claim 17, wherein at least a portion of the propulsion system is integrated with the buoyant device.

19. The propulsion system of claim 18, further comprising a steering device connected to the rudder, such that the steering device controls the orientation of the rudder.

* * * * *